US010787008B2

(12) United States Patent
Rubio et al.

(10) Patent No.: US 10,787,008 B2
(45) Date of Patent: Sep. 29, 2020

(54) CUTTING PRINT SUBSTRATES

(71) Applicant: HEWLETT-PACKARD DEVELOPMENT COMPANY, L.P., Spring, TX (US)

(72) Inventors: Leticia Rubio, Sant Cugat del Valles (ES); Xavier Quintero Ruiz, Sant Cugat del Valles (ES); Utpal Kumar Sarkar, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/494,967

(22) PCT Filed: Jun. 20, 2017

(86) PCT No.: PCT/US2017/038275
§ 371 (c)(1),
(2) Date: Sep. 17, 2019

(87) PCT Pub. No.: WO2018/236348
PCT Pub. Date: Dec. 27, 2018

(65) Prior Publication Data

US 2020/0009885 A1 Jan. 9, 2020

(51) Int. Cl.
*B41J 11/66* (2006.01)

(52) U.S. Cl.
CPC ..... *B41J 11/663* (2013.01)

(58) Field of Classification Search
CPC ..... B41J 11/66; B41J 11/663; B41J 11/666; B41J 11/70; B41J 11/706
See application file for complete search history.

(56) References Cited

U.S. PATENT DOCUMENTS

| | | | | |
|---|---|---|---|---|
| 7,095,526 | B1 | 8/2006 | Housel | |
| 7,815,382 | B2 | 10/2010 | Monclus et al. | |
| 8,861,988 | B2 | 10/2014 | Lawniczak | |
| 8,866,861 | B2 | 10/2014 | Schuh et al. | |
| 10,179,464 | B2 * | 1/2019 | Schutz | B26D 5/34 |
| 2010/0158545 | A1 | 6/2010 | No et al. | |
| 2013/0149019 | A1 | 6/2013 | Sugimura | |

FOREIGN PATENT DOCUMENTS

WO WO-2016079268 A1 5/2016

OTHER PUBLICATIONS

Epson, Inc., "Epson Stylus Pro 7600/9500," Product Data Sheet, 2003, 4 p.
HPDC; "International Search Report and Written Opinion," dated Dec. 21, 2017, International App. No. PCT/US2017/038275, 7 p.

* cited by examiner

*Primary Examiner* — Huan H Tran
(74) *Attorney, Agent, or Firm* — HP Inc. Patent Department

(57) ABSTRACT

Print apparatus is controlled to execute a print operation comprising a plurality of print sweeps onto a print zone of a print substrate and a corresponding plurality of print advances of the print substrate between successive print sweeps. Print apparatus is controlled to execute an intermediate cutting operation between a pre-cut print sweep and a successive post-cut print sweep of the plurality of print sweeps.

15 Claims, 6 Drawing Sheets

CUTTING PRINT SUBSTRATES

BACKGROUND

The disclosure relates to cutting a print substrate.

Images may be printed on a print substrate, such as a web or sheet of paper or card. After printing, the printing substrate may be trimmed to the boundaries of the image so that the image is borderless.

Other methods of borderless printing include printing at an edge of a substrate. Such methods may use a platen supports for the substrate, and an un-supported region covered with an absorbent material. The edge may be printed on when it is over the absorbent material, to prevent printing onto the supports.

BRIEF DESCRIPTION OF DRAWINGS

Examples will now be described, by way of non-limiting example, with reference to the accompanying drawings, in which.

DETAILED DESCRIPTION

Figure 1:
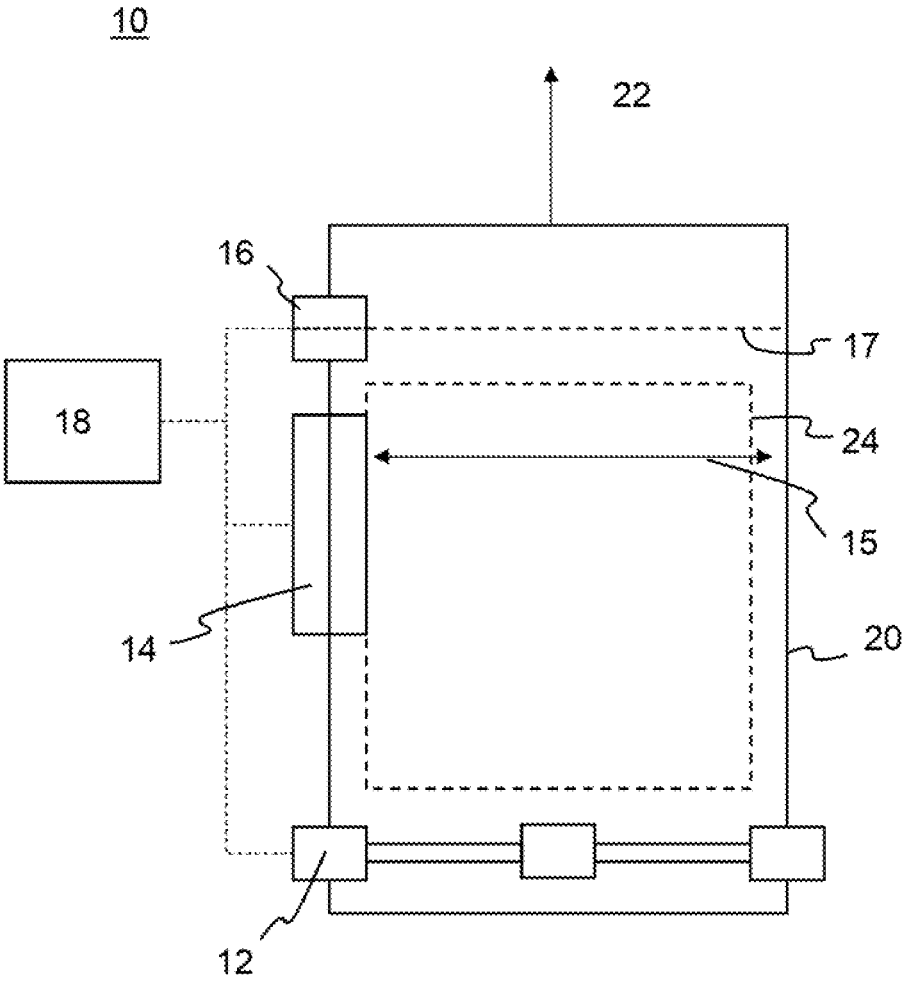
FIG. 1 is a simplified schematic of an example printing apparatus.

FIG. 1 shows example print apparatus 10 comprising a cutter 16, printhead 14, media advancer 12 and a controller 18. The print apparatus 10 is for printing on a substrate 20, such as a web or sheet of print media such as paper or card. In the example of FIG. 1 the substrate is a sheet of paper.

The media advancer 12 is to receive the substrate 20 and advance it along a longitudinal feed direction 22 past the printhead 14 and the cutter 16, which in this example are downstream of the media advancer 12 with respect to the feed direction 22. For example, the print apparatus 10 may comprise a platen, and the media advancer 12 may be to advance the substrate 20 onto the platen for a printing onto the substrate by the printhead 14, which may oppose the platen. For example, the media advancer 12 may comprise a roller to frictionally engage the substrate 20 and rotate to advance it forwards.

In the example print apparatus 10 of FIG. 1, the printhead 14 is a scanning printhead to execute a print sweep in which the printhead 14 traverses over the substrate 20 along a scanning direction 15 orthogonal to the feed direction 22, to print onto a print zone 24 of the substrate 20. In the present disclosure, the term sweep refers to an event along the scanning axis (e.g. along the scanning direction 15). The term print sweep refers to a printing by moving a printhead 14 along the scanning axis 15. In this example, the printhead 14 is an inkjet printer to eject a print fluid onto the print zone 24, but in other examples other types of printheads may be used. The print zone 24 corresponds to content to be printed on the substrate 20, for example an image. In this example the print zone 24 is rectangular and has forward and rear boundaries parallel with the scanning direction 15.

The controller 18 is to control the media advancer 12 to advance the substrate 20 by specified advances along the longitudinal feed direction, as will be described below. For example, the controller 18 may be to control the media advancer 12 based on print operation instructions, as will be described below.

The printhead 14 is to print onto the print zone 24 in successive swathes having a swath dimension which is the longitudinal extent of the printed swath (i.e. the extent of the swath along the longitudinal feed direction 22). The swath dimension may be variable, for example by activating a subset of nozzles of an inkjet printhead. For an inkjet printhead, the maximum swath dimension corresponds to the longitudinal extent of the nozzles of the printhead 14. The print apparatus 10 therefore has a swath zone having a longitudinal extent and position corresponding to the maximum swath dimension at the longitudinal position of the printhead 14. The swath zone represents the region in the print apparatus 10 where a swath is printed (i.e. before the respective swath is advanced through the apparatus away from the printhead).

The controller 18 is to control the printhead 14 to execute a print sweep, for example based on print operation instructions, as will be described below.

The cutter 16 is to cut the substrate 20 at a cutting position 17 of the print apparatus 10 which is downstream of the swath zone (i.e. downstream of the nozzles of the printhead 14). In this example, the longitudinal dimension of the printhead 14 corresponds to the longitudinal position of the nozzles, and so the cutting position 17 and cutter 16 is downstream of the printhead 14. In this example, the cutter 16 is to traverse the substrate 20 along the scanning direction 15 to cut the substrate 20. In this particular example, the cutter 16 comprises cooperating blades to engage either side of a substrate and converge at a nip, such that movement of the cutter 16 along the scanning direction causes the substrate 20 to be cut at the nip to sever the substrate 20 at a cut location of the substrate 20 corresponding to the cutting position 17.

The controller 18 is to control the cutter 16 to traverse along the scanning direction 15 to cut a substrate 20 in a cutting operation, as will be described below.

FIGS. 2*a*-2*e* show partial views of an example substrate 20 at successive stages of an example print operation in which an image is printed on a print zone 24 using the print apparatus 10 described above with respect to FIG. 1.

Each of FIGS. 2*a*-2*e* show a portion of the substrate 20 in registration with the printhead 14 and a cutting position 13. In this simplified example, the printhead 14 comprises three longitudinally-spaced nozzles 141, 142, 143, such that the printhead 14 defines a swath zone having a longitudinal extent corresponding to the three nozzles 141-143. Each nozzle 141, 142, 143 is independently controllable to so as to vary a swath dimension of a swath printed on the print zone 24 during any particular print sweep.

In this example print operation, the image is to be printed on the print zone 24 by printing overlapping swathes over successive print operations. In particular, each portion of the print zone 24 is to be printed on in three successive print sweeps by a respective one of the nozzles 141, 142, 143. FIGS. 2*a*-2*e* show four such portions of the print zone 24 at respective stages of the print operation, as will be described in detail below.

Figures 2A, 2B, 2C, 2D, 2E:
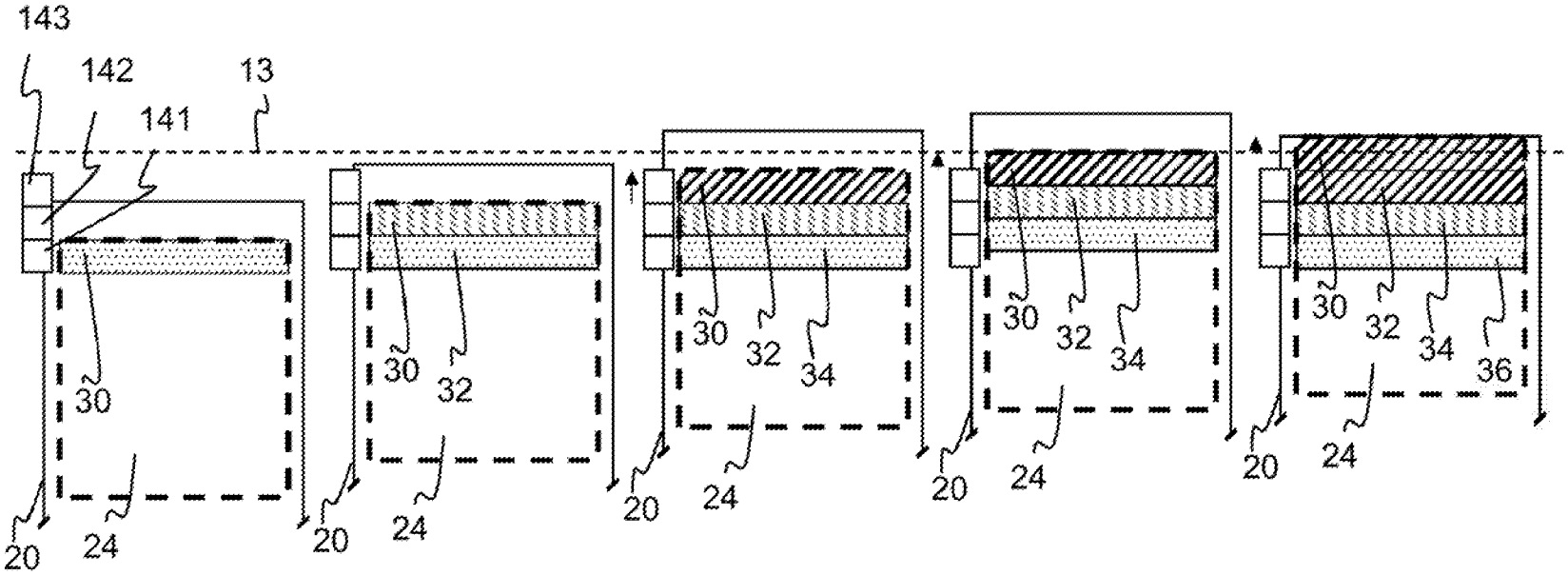
FIGS. 2*a*-2*e* schematically show a print substrate at successive stages of a print operation.

FIG. 2*a* shows the substrate 20 in a first position corresponding to a first print sweep. In the first position the substrate 20 is positioned so that the first nozzle 141 farthest from the cutting position 13 is aligned with a first portion 30 of the print zone 24 which defines a forward edge of the print zone 24. The forward edge of the print zone 24 is disposed rearwardly of the cutting position 13. In the first print sweep the first nozzle 141 prints onto the first portion 30 of the print zone 24.

The substrate is then advanced by a first print advance (for example, by the media advancer 12) to a second position as shown in FIG. 2*b* in preparation for a second print sweep. In the second print sweep, the second nozzle 142 adjacent the first nozzle 141 is aligned with and prints onto the first portion 30 of the print zone 24 a second time. Simultaneously, the first nozzle 141 is aligned with and prints onto a second portion 32 of the print zone 24 rearwardly adjacent the first portion 30 with respect to the longitudinal feed direction.

The substrate 20 is then advanced by a second print advance so that the substrate 20 is in a third position as shown in FIG. 2*c*, in preparation for a third print sweep. In the third print sweep, the third nozzle 143 closest to the cutting position 13 is aligned with and prints onto the first portion 30 of the print zone a third time; the second nozzle 142 is aligned with and prints onto the second portion 32 of the print zone for a second time, and the first nozzle 141 is aligned with and prints onto a third portion 34 rearwardly adjacent the second portion 32 for a first time.

In the simplified example of FIGS. 2*a*-2*b*, the print advance between print sweeps is constant and corresponds to the position of the respective nozzles 141, 142, 143. However, the print advance may be variable and each respective portion of the print zone may be printed on by a plurality of nozzles in a respective print sweep.

In this example, a fourth print sweep is to be conducted with the substrate 20 in a fourth position in which the third nozzle 143 is aligned with the second portion 32. A third print advance to move the substrate 20 from the third position to the fourth position would cause the forward edge of the print zone 24 to pass the cutting position 13.

Instead of executing such a third print advance directly, an intermediate cutting operation is performed in which the substrate is advanced by a pre-cut advance, cut at a cut location of the substrate, and subsequently advanced by a post-cut advance.

In this example, the cut location of the substrate 20 (i.e. where the substrate 20 is to be cut) is the forward edge of the print zone 24. Accordingly, the substrate 20 is advanced by a pre-cut advance which is determined so that the forward edge of the print zone 24 is aligned with the cutting position 13 in an intermediate position of the substrate 20 as shown in FIG. 2*d*. No print sweep is conducted in the intermediate position. The cutter 16 is moved along the scanning direction 15 to cut the substrate 20 along the forward edge of the print zone 24.

The substrate 20 is then advanced by a post-cut advance to the fourth position as described above, and as shown in FIG. 2*e*, in preparation for a fifth print sweep. In the fourth position, the forward edge of the print zone (which is coincident with the trimmed edge of the substrate 20) is forward of the cutting position 13, and the cutting position 13. A total advance of the pre-cut advance and the post cut advance is equal to the third print advance.

In the fourth print sweep, the third nozzle 143 is aligned with and prints onto the second portion 32 for a third time; the second nozzle 142 is aligned with and prints onto the third portion 34 for a second time; and the first nozzle 141 is aligned with and prints onto a fourth portion 36 of the print zone rearwardly adjacent the third portion for a first time.

FIGS. 2*a*-2*e* use shading to indicate the number of times a respective portion has been cumulatively printed on in successive print sweeps of the print operation.

Once printing on the print zone 24 is complete, the substrate 20 may be advanced so that a cut location at the rearward edge of the print zone 24 aligns with the cutting position 13 of the print apparatus, and the substrate 20 may be cut at rearward edge so that the print zone 24 has no forward and rear borders.

In the above example, the substrate 20 is advanced so that portions of the print zone 24 are printed on multiple times by overlapping print swaths. In this example, a print swath corresponding to a print sweep after the intermediate cutting operation overlaps a print swath corresponding to a print sweep before the intermediate cutting operation. In particular, the fourth print sweep is conducted after the cutting operation and generates (or is associated with) a print swath extending over the second, third and fourth portions 32, 34, 36 of the print zone, whereas third print sweep is conducted before the cutting operation and generates an overlapping print swath extending over the first, second and third portions 30, 32, 34 of the print zone.

In other examples, print swaths corresponding to different print sweeps may not overlap. Nevertheless, in such other examples a region of the print zone rearward of the cut location (e.g. the forward edge of the print zone 24) may be printed on in a pre-cut print sweep and a post-cut print sweep. In particular, when there is a longitudinal spacing between the cut location and the swath zone, and when there is no gap on the print zone 24 between successive print swathes, a region of a print zone rearward of a cut location may be printed on during a pre-cut print sweep and a post-cut print sweep. For example, the pre-cut print sweep and the post-cut print sweep may print on adjacent portions of the region rearward of the cut location.

Figure 3:
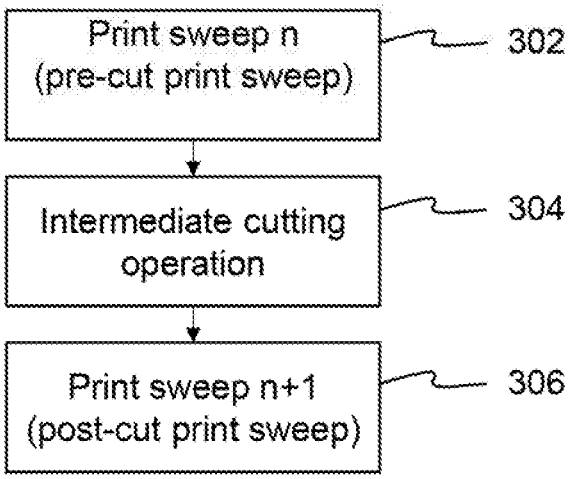
FIGS. 3-4 are flowcharts of methods of controlling a print operation.

FIG. 3 is a flowchart of an example print operation comprising a plurality of print sweeps onto a print zone of a substrate and a corresponding plurality of print advances of the substrate between successive print sweeps. The following description refers to a series of print sweeps and print advances that are numbered with respect to a reference print sweep n, and corresponding positions of a substrate with reference to a reference substrate position $P_n$. As will be described below, the reference print sweep n is a pre-cut print sweep, such that the next print sweep n+1 occurs after cutting of the substrate.

In this example, the print operation is conducted based on print operation instructions including instructions to perform an intermediate cutting operation. The example print operation will be described, by way of example, with reference to the example print apparatus 10 described above with respect to FIG. 1.

A substrate 20 is positioned in the print apparatus 10 in a pre-cut substrate position $P_n$ in preparation for a pre-cut print sweep onto a portion of a print zone 24. For example, the controller 18 may cause the media advancer 12 to advance the substrate 20 to the pre-cut substrate position $P_n$ based on the print operation instructions.

In block 302, the controller 18 of the print apparatus 10 controls the printhead 14 to execute a pre-cut print sweep n (the reference print sweep) over the substrate to print a swath of an image on a portion of the print zone 24, based on the print operation instructions. The pre-cut print sweep n may be a first print sweep of a print operation, or it may be a subsequent print sweep, such as the third print sweep described above with respect to the example of FIG. 2*b*.

The media is to be advanced by a print advance $A_n$ to a successive substrate position $P_{n+1}$, which in this example is a post-cut substrate position $P_{n+1}$ corresponding to a post-cut print sweep n+1. In this example, an intermediate cutting operation is to be conducted between the pre-cut print sweep n and the post-cut print sweep n+1, such that the print advance $A_n$ comprises a pre-cut advance and a post-cut advance, as will be described below.

In block 304, the intermediate cutting operation is conducted based on the print operation instructions. In particular, the controller 18 controls the media advancer 12 to advance the substrate 20 by a pre-cut advance as specified by print operation instructions, the controller 18 controls the cutter 16 to cut the substrate 20 at the cutting position 17, and the controller 18 subsequently controls the media advancer 12 to advance the substrate by a post-cut advance as specified by the print operation instructions, such that the substrate 20 is advanced to a post-cut substrate position $P_{n+1}$. In this example, the print operation instructions are defined so that a forward edge of the print zone 24 is aligned with the cutting position 17 of the print apparatus 10 after the pre-cut advance. However, in this particular example the controller 18 determines the pre-cut advance directly based on the print operation instructions, rather than by determining a suitable pre-cut advance to align the forward edge and the cutting position 17.

In block 306, the controller 18 controls the printhead 14 to execute the post-cut print sweep n+1 based on the print operation instructions.

The print operation instructions may define more than two print sweeps, and there may be a corresponding plurality of print advances between successive print sweeps.

Figure 4:
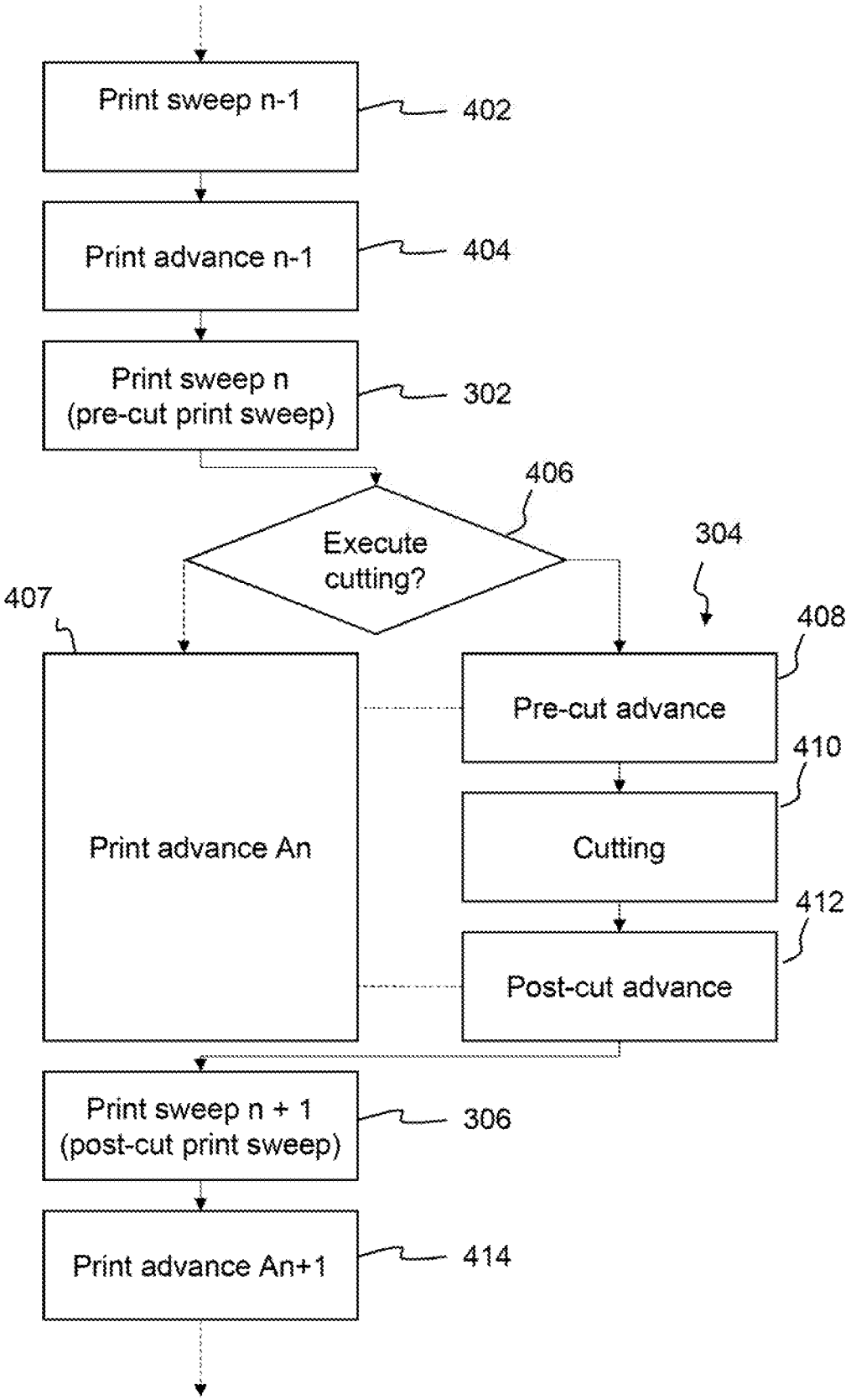

FIG. 4 shows a further method of controlling a print operation, which again will be described by way of example with reference to the print apparatus 10 of FIG. 1. In the method of FIG. 4, the intermediate cutting operation 304 is conducted to replace a print advance $A_n$ of a print operation comprising a series of print sweeps and corresponding print advances between successive print sweeps.

As with the method described above with respect to FIG. 3, the print sweep immediately before the intermediate cutting operation is a reference print sweep denoted print sweep n, with other print sweeps, print advances and substrate positions of a substrate referred to with reference to n (e.g. n+1, n−1).

In this example, the print operation comprises a series of print sweeps numbering more than three, but three print sweeps are shown in FIG. 4 for clarity.

In block 402, the controller controls the printhead 14 to execute a print sweep n−1 based on print operation instructions when the substrate 20 is in a corresponding substrate position $P_{n-1}$, to print a print swath on a portion of the print zone 24 of the substrate 20.

In block 402 the controller controls the media advancer 14 to advance the substrate 20 by a print advance $A_{n-1}$ based on print operation instructions so that the substrate 20 is disposed in a substrate position $P_n$ in preparation for a subsequent print sweep n.

In block 302 the controller controls the printhead 14 to execute the print sweep n as described above with respect to FIG. 3, so that a further swath is printed on an adjacent portion of the print zone 24.

In this example, the print operation instructions include instructions indicating that the substrate 20 is to be cut at a forward edge of the print zone 24. The instructions may not specify at which point of the print operation instructions the forward edge is to be cut. For example, the print operation instructions may be partially defined in the printer after receipt of a print job (i.e. precursor instructions relating to the image to be printed) to specify that the edge is to be cut. In this example, the controller 18 is to determine at which point of the print operation the substrate 20 is to be cut.

In this particular example, the controller 18 determines the cutting position 17 of the print apparatus, and the relative position of the cut location (i.e. the forward edge of the print zone) with respect to the cutting position 17 before executing each print advance. In FIG. 4, one such determination is shown for clarity (block 406) before the particular print advance $A_n$ that would cause the cut location to pass the cutting position 17. In block 406, the controller 18 determines that the cut location would move past the cutting position 17, based on the extent of the print advance along the longitudinal feed direction 22, and the relative position of the cut location and the cutting position 17. Accordingly, the controller 18 determines to execute an intermediate cutting operation 304 in place of the respective print advance $A_n$ between the success print sweeps n, n+1. In other examples, the controller may determine when to execute the intermediate print operation before commencing the print operation, and adjust the print operation instructions accordingly (as will be described below with respect to FIG. 5).

In block 408, the controller 18 determines the pre-cut advance along the longitudinal feed direction 22 to advance the cut location into alignment with the cutting position 17 of the print apparatus 10, and controls the media advancer 12 to advance the substrate 20 by the pre-cut advance accordingly.

In block 410, the controller 18 controls the cutter 16 to cut the substrate 20 by traversing the substrate along the scanning direction 15.

In block 412, the controller 18 determines a post-cut advance based on the print advance $A_n$ that was replaced by the intermediate cutting operation, and the pre-cut advance corresponding to a first part of the print advance $A_n$, such that the pre-cut advance and the post-cut advance are together equal to the respective print advance $A_n$. In other words, the print advance $A_n$ may comprise or consist of the pre-cut advance and the post-cut advance. The controller 18 controls the media advancer 12 to advance the substrate 20 by the post-cut advance accordingly, in preparation for a post-cut print sweep n+1.

In block 306, the controller 18 controls the printhead 14 to execute a post-cut print sweep n+1 based on the print operation instructions.

In block 414, the controller 18 controls the media advancer 12 to advance the substrate 20 by a print advance $A_{n+1}$ to a further substrate position $P_{n+1}$ corresponding to a successive print sweep n+1. As indicated by the dashed arrow in FIG. 4, further print sweeps and print advances are conducted until the print operation is complete.

Once all print sweeps of the print operation are complete, the controller 18 may control the media advancer 12 to advance the substrate 20 so that a rear edge of the print zone 24 is aligned with the cutting position 17, and may control the cutter 16 to cut the substrate 20 at the rear edge of the print zone.

Figure 5:
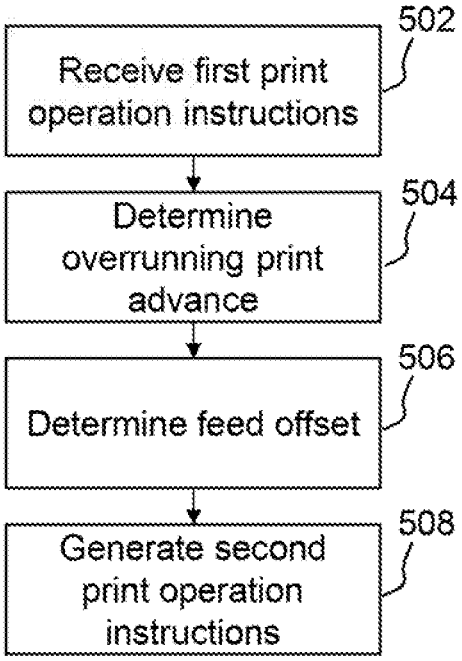
FIG. 5 is a flowchart of a method of generating print operation instructions.

FIG. 5 shows a flowchart of a method of generating print operation instructions. The method may be conducted by a controller of a print apparatus, or may be conducted remotely from a print apparatus, for example on a remote computer or server.

In block 502, first print operation instructions are received. For example, the print operation instructions may define a series of print sweeps and a corresponding plurality of print advances between successive print sweeps for printing on a print zone of a print substrate. The print operation instructions may define a type of printer which may have a pre-determined cutting position relative a swath zone of the printer (i.e. the longitudinal region in the printer at which a printhead prints onto a swath of a substrate), or the print operation instructions may define the relative position of a cutting position relative a printhead or the print zone.

In block 504, a print advance $A_n$ of the first print operation instructions corresponding to advance of a cut location on the print substrate past a cutting position of the print apparatus is determined, for example by simulation of the print operation (i.e. without performing the print operation). The determined print advance $A_n$ is referred to herein as the overrunning print advance. For example, a position of the cut location after each advance may be determined, and the first of such positions that is beyond the cutting position may be determined. Accordingly, the respective print advance $A_n$ may be determined. The cut location may correspond to a forward edge of a print zone. For example, the cut location may be the forward edge, or it may be inset from the forward edge by a margin to ensure a borderless substrate at the forward edge after cutting.

In block 506, a feed offset corresponding to an offset between the cut location and the cutting position is determined. For example, the feed offset may be determined with respect to the position of the substrate immediately before the overrunning print advance, as the forward advance (i.e. along the longitudinal feed direction) to align the cut location and the cutting position. In other examples, the feed offset may be determined with respect to the position of the substrate immediately after the overrunning print advance (i.e. the distance along the longitudinal feed direction by which the cutting position was overrun). The feed offset can be used to align the cut location with the cutting position by modification or regeneration of the print operation instructions, as will be described below.

In block 508, second print operation instructions are defined based on the first print operation instructions and the feed offset to align the cut location with the cutting position during the print operation.

The feed offset may be determined and applied in the second print operation instructions in different ways to align the cut location and the cutting position, as will be described below with respect to FIGS. 6 and 7.

Figure 6:
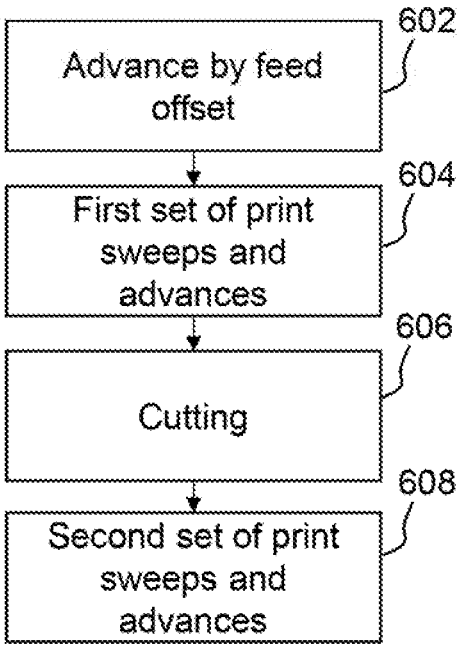
FIGS. 6 and 7 schematically show print operation instructions.

FIG. 6 shows a first example of second print operation instructions that may be generated based on a feed offset and first print operation instructions. In this example, the feed offset is determined with respect to the position of the substrate immediately after the overrunning print advance of the first print operation instructions. Accordingly, the feed offset represents the amount that the cut location is to overrun the cutting position based on the first print operation instructions. In this example, block 602 of the second print operation instructions includes instructions to advance the substrate by the feed offset before the print sweeps commence. This advance has the effect of increasing the size of the unprinted border on the forward edge of the sheet substrate, as compared with the substrate printed based on the first print operation instructions.

In block 604, the second print operation instructions include instructions to execute a first set of print sweeps and corresponding print advances between those print sweeps. The first set of print sweeps and advances corresponds to all print sweeps and print advances of the first print operation instructions up to and including the overrunning print advance $A_n$. Owing to the feed offset before commencement of the print sweeps, the print advance $A_n$ corresponding to the overrunning print advance $A_n$ of the first print operation instructions brings the cut location on the substrate into alignment with the cutting position, ready for cutting.

In block 606, the second print operation instructions include instructions to conducting an intermediate cutting operation comprising cutting the substrate at the cut location after the print advance $A_n$. In this example, the intermediate cutting operation does not include any pre-cut advance or post-cut advance to align the cut location of the substrate with the cutting position of the print apparatus.

In block 608, the second print operation instructions include instructions to conduct a second set of print sweeps and respective print advances, which correspond to the remaining print sweeps and print advances of the first print operation instructions, starting with the print sweep n+1 after the overrunning print advance.

Second print operation instructions as shown in FIG. 6 have the effect of shifting the print zone backward (with respect to the longitudinal feed direction) so as to align the cut location and the cutting position at a subsequent stage of printing.

Figure 7:
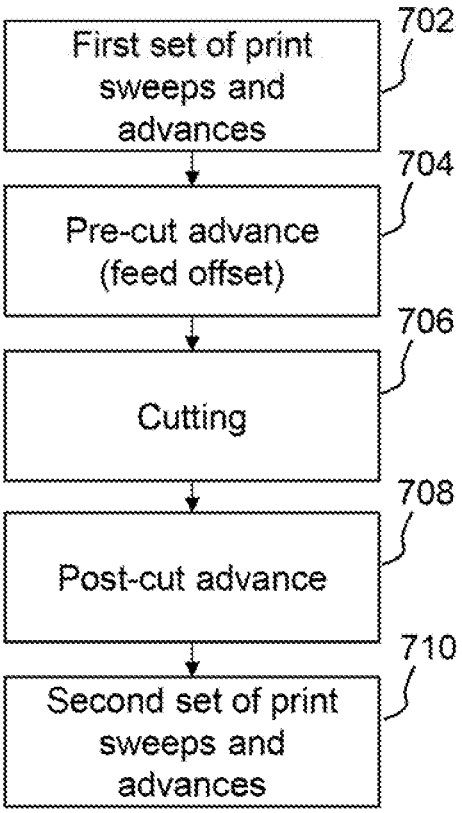

FIG. 7 shows a second example of second print operation instructions generated based on first print operation instructions and the feed offset. In this example, the feed offset is determined with respect to the position of the substrate immediately before the overrunning print advance $A_n$ of the first print operation instructions. Accordingly, the feed offset represents a forward advance to be applied in place of the overrunning print advance $A_n$.

In block 702, the second print operation instructions include instructions to conduct a first set of print sweeps and print advances corresponding to all print sweeps and print advances of the first print operation instructions up to but not including the overrunning print advance.

In blocks 704, 706, 708, the second print operation instructions include instructions to conduct an intermediate cutting operation. In block 704, the second print operation instructions include instructions to execute a pre-cut advance corresponding to the feed offset, to align the cut location on the substrate with the cutting position of the print apparatus.

In block 706, the second print operation instructions include instructions to cut the substrate when the cut location is aligned with the cutting position.

In block 708, the second print operation instructions include instructions to execute a post-cut advance which corresponds to the overrunning print advance $A_n$ of the first print operation instructions minus the pre-cut advance. Accordingly, in this example the intermediate cutting operation includes a pre-cut advance and a post-cut advance that sum to the overrunning print advance $A_n$ of the first print operation instructions, such that the intermediate cutting operation effectively replaces the overrunning print advance $A_n$ of the first print operation instructions.

In block 710, the second print operation instructions include instructions to conduct a second set of print sweeps and advances, which corresponds to the remainder of the print sweeps and print advances of the first print operation instructions after the overrunning print advance $A_n$.

When the example second print operation instructions are executed by a print apparatus, there is no print sweep between the pre-cut advance and the post-cut advance. In such a print operation, there is a pre-cut print sweep before the intermediate cutting operation, and the next print sweep after the pre-cut pring sweep occurs after the intermediate cutting operation. In other words, both the pre-cut advance and the post-cut advance occur before the next print sweep, such that there is no printing during the intermediate cutting operation.

By controlling print apparatus having a forward cutting position to align a cut location of a substrate with a cutting position of the print apparatus for cutting during printing, a substrate may be advanced in a forward direction through the print apparatus for both printing and cutting, without reversing the substrate.

Figure 8:
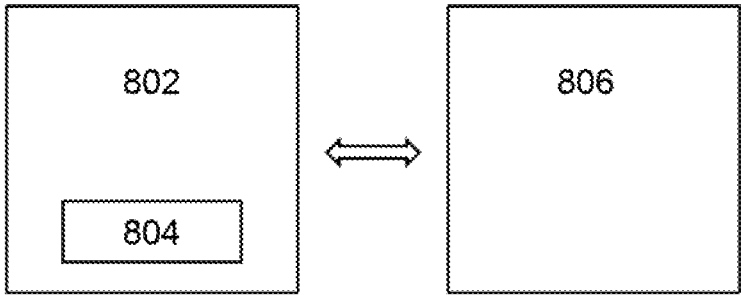
FIG. 8 schematically shows a non-transitory machine-readable medium and a processor.

Examples in the present disclosure can be provided as methods, systems or machine readable instructions, such as hardware or software-hardware combinations. Examples are described herein as circuitry (e.g. a controller including circuitry such as a programmable logic device, and/or a processor and a memory containing instructions) or a combination of circuitry and executable machine-readable instructions. Such machine readable instructions may be included on a computer readable storage medium (including but is not limited to disc storage, CD-ROM, optical storage, etc.) having computer readable program codes therein or thereon. FIG. 8 shows an example machine readable storage medium 802 comprising a memory encoded with instructions 804. The instructions are executable by a processor 806. The instructions may be to execute a method as described above with respect to any of the flowcharts of FIGS. 3-5.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices, such as the controller of the print apparatus, may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A non-transitory machine-readable medium containing instructions that, when executed by a processor, cause the processor to:

control a print apparatus to execute a print operation comprising a plurality of print sweeps onto a print zone of a print substrate wherein the print substrate is advanced by a print advance between successive print sweeps; and control the print apparatus to execute an intermediate cutting operation between a pre-cut print sweep and a successive post-cut print sweep of the plurality of print sweeps.

2. The non-transitory machine-readable medium of claim 1, wherein each print sweep is to print onto a respective print swath of the print zone, and wherein a print swath corresponding to a print sweep after the intermediate cutting operation overlaps a print swath corresponding to a print sweep before the intermediate cutting operation.

3. The non-transitory machine-readable medium of claim 1, wherein the intermediate cutting operation is to cut the print substrate at a forward edge of the print zone.

4. The non-transitory machine-readable medium of claim 1, wherein the intermediate cutting operation comprises cutting the print substrate between a pre-cut advance and a post-cut advance, wherein a total advance of the pre-cut advance and the post-cut advance is equal to the print advance between the pre-cut print sweep and the post-cut print sweep.

5. The non-transitory machine-readable medium of claim 4, wherein the instructions, when executed by the processor, cause the processor to determine the pre-cut advance so that the print substrate is cut in the intermediate cutting operation at a cut location corresponding to a forward edge of the print zone.

6. The non-transitory machine-readable medium of claim 4, wherein the instructions, when executed by the processor, cause the processor to control print apparatus to execute the intermediate cutting operation so that no print sweep occurs between the pre-cut advance and the post-cut advance of the intermediate cutting operation.

7. A non-transitory machine-readable medium containing instructions that, when executed by a processor, cause the processor to:

receive first print operation instructions to execute a print operation comprising a plurality of print sweeps onto a print zone of a print substrate, wherein the print substrate is advanced by a respective print advance between successive print sweeps;

generate second print operation instructions for execution by a print apparatus based on the first print operation instructions by:

determining an overrunning print advance of the first print operation instructions corresponding to advance of a cut location on the print substrate past a cutting position of the print apparatus;

determining a feed offset based on the overrunning print advance to align the cut location with the cutting position; and defining the second print operation instructions for the print operation based on the first print operation instructions and the feed offset to align the cut location with the cutting position during the print operation;

wherein the second print operation instructions include an intermediate cutting operation between successive print sweeps to cut the print substrate at the cutting position.

8. The non-transitory machine-readable medium of claim 7, wherein the second print operation instructions are defined to shift a location of the print zone on the substrate by the feed offset so that the cut location is aligned with the cutting position between successive print advances.

9. The non-transitory machine readable medium of claim 7, wherein the second print operation instructions are defined so that the overrunning print advance is replaced with an intermediate cutting operation comprising a pre-cut advance equal to the feed offset, a post-cut advance and cutting of the print substrate therebetween;

whereby the pre-cut advance causes the cut location of the print substrate to align with the cutting position for cutting.

10. The non-transitory machine-readable medium of claim 9, wherein a total advance of the pre-cut advance and the post-cut advance is equal to the overrunning print advance of the first print operation instructions.

11. Print apparatus comprising:

a scanning printhead to execute a print sweep over a print substrate;

a media advancer to advance a print substrate along an advance direction between successive print sweeps by respective print advances;

a cutter downstream of the printhead with respect to the advance direction; and a controller to execute an intermediate cutting operation during a print operation comprising a plurality of successive print sweeps over a print zone of a print substrate, wherein the print substrate is advanced by a print advance between successive print sweeps;

wherein the controller is to execute the intermediate cutting operation between a pre-cut print sweep and a successive post-cut print sweep of the plurality of print sweeps.

12. The print apparatus of claim 11, wherein each print sweep is to eject print agent onto a respective print swath of the print zone, and wherein the controller is to execute the print operation and the intermediate cutting operation so that a print swath corresponding to a print sweep after the intermediate cutting operation overlaps a print swath corresponding to a print sweep before the intermediate cutting operation.

13. The print apparatus of claim 11, wherein the controller is to execute the intermediate cutting operation to cut the print substrate at a forward edge of the print zone.

14. The print apparatus of claim 11, wherein the intermediate cutting operation comprises a pre-cut advance, cutting the print substrate, and a post-cut advance; and wherein the print advance between the pre-cut print sweep and the post-cut print sweep comprises the pre-cut advance and the post-cut advice.

15. The print apparatus of claim 14, wherein the controller is to execute the intermediate print operation so that no print sweep occurs between the pre-cut advance and the post-cut advance of the intermediate cutting operation.

* * * * *